US005815766A

United States Patent [19]

Miller et al.

[11] Patent Number: 5,815,766

[45] Date of Patent: Sep. 29, 1998

[54] METHOD AND APPARATUS FOR CLEAN CONVENIENT COPY SHEET JAM CLEARANCE IN AN ELECTROSTATOGRAPHIC MACHINE

[75] Inventors: Eugene F. Miller, Fairport; Patrick T. Pendell, Rochester, both of N.Y.

[73] Assignee: Xerox Corporation, Stamford, Conn.

[21] Appl. No.: 831,449

[22] Filed: Mar. 31, 1997

[51] Int. Cl.[6] ..... G03G 15/00

[52] U.S. Cl. ..... 399/21; 271/259

[58] Field of Search ..... 399/21, 388; 271/258.01, 271/259

[56] References Cited

U.S. PATENT DOCUMENTS

| | | | |
|---|---|---|---|
| 4,231,567 | 11/1980 | Ziehm | 271/259 |
| 4,816,872 | 3/1989 | Okamoto et al. | 399/364 X |
| 5,049,924 | 9/1991 | Moro et al. | 271/258.01 X |
| 5,328,168 | 7/1994 | Fox | 271/259 |
| 5,479,240 | 12/1995 | Lee et al. | 399/21 |
| 5,502,545 | 3/1996 | Tsuruoka | 399/21 |
| 5,655,173 | 8/1997 | Hirai et al. | 399/21 |
| 5,678,123 | 10/1997 | Kim | 399/21 |

*Primary Examiner*—Arthur T. Grimley
*Assistant Examiner*—Sophia S. Chen
*Attorney, Agent, or Firm*—Tallam I. Nguti

[57] ABSTRACT

An automatic apparatus and method for controlling and enabling clean and convenient clearance of a stalled copy sheet from a copy sheet handling system of an electrostatographic reproduction machine. The automatic apparatus and method include a programmable controller for declaring detection of an error in copy sheet movement; position determiner for determining a first actual position of the copy sheet at a moment of detection of an error. The position determiner means includes a first sensing device mounted upstream of an image transfer station of the machine relative to a direction of sheet movement, and a second sensing device, mounted downstream of the first sensing device relative to the direction of sheet movement. The automatic apparatus and method also include sheet control and moving device connected to the programmable controller for changing a position of the copy sheet from the first actual position to one of a downstream and an upstream new and convenient sheet removal positions, depending on the first actual position of the copy sheet relative to the first sensing device and the second sensing device.

7 Claims, 3 Drawing Sheets

METHOD AND APPARATUS FOR CLEAN CONVENIENT COPY SHEET JAM CLEARANCE IN AN ELECTROSTATOGRAPHIC MACHINE

BACKGROUND

The present invention relates generally to electrostatographic reproduction machines, and more specifically concerns a method and apparatus for clean convenient copy sheet jam clearance or clean convenient removal of stalled copy sheets in a high speed sheet transporting machine.

In a typical electrostatographic reproduction process machine, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This process records an electrostatic latent image on the photoconductive member corresponding to the informational areas contained within the original document.

After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image forming a toner powder image on the photoconductive member. The toner powder image is then transferred at an image transfer station, from the photoconductive member, to a copy substrate such as a copy sheet of paper. Thereafter, heat or some other treatment is applied to the toner particles at a fusing station to permanently fuse and affix the toner powder image to the copy sheet or substrate.

The copy sheet or substrate typically is fed automatically from a stack supply thereof, along a sheet transport path that includes a sheet registration subassembly, to the image transfer station. For proper and high quality registration of the image transferred to the copy sheet, the copy sheet must be transported in a timed and registered manner to the sheet registration subassembly and the transfer station. Presence and proximity sensors can be used for assisting the achievement of such proper and timed registration of each copy sheet being transported to the transfer station.

Typically, the failure of a sheet being transported to activate any of the above sensors at the control point in time or space, will register as a machine error. Detection of such an error usually results in a machine shutdown, and a call or alert for an operator to remove or clear the out of control sheet (now a jammed or stalled sheet), wherever it may be, along the sheet transport path. For example, such errors and sheet jams can be caused by late sheet arrival to registration sensors at the registration subassembly, or by late sheet arrival to a prefuser sensor located downstream of the image transfer station, relative to a direction of sheet movement.

In some machines, conventional detection of such an error, and the consequential machine shutdown following it, can leave the jammed or stalled sheet or sheets to be cleared, in relatively very difficult and hard to reach locations along the sheet transport path. This is particularly true for machines in which the sheet registration subassembly is located in a hard to reach position, such as at a position very near the floor level of a ground standing machine, or in a congested part of the machine.

SUMMARY OF THE INVENTION

In accordance with one aspect of the present invention, there is provided a method of cleanly and conveniently controlling and enabling clearing of a stalled copy sheet in a copy sheet handling system of an electrostatographic reproduction machine. The method includes the steps of declaring an error detected in copy sheet movement through the copy sheet handling system; determining a first actual position of a copy sheet among several possible such positions within the handling system at a moment of error detection; identifying a location of a lead edge of the copy sheet in relation to a first sensing device located upstream of an image transfer station of the machine and in relation to a second sensing device located at least at the image transfer station; automatically changing a position of the copy sheet from the determined first actual position to one of two new and convenient sheet removal positions depending on the first actual position of the copy sheet at a moment of error detection; stopping the machine after changing the position of the copy sheet; and alerting an operator of a copy sheet to be removed from the handling system; thereby enabling safe and convenient removal of the copy sheet, and preventing the copy sheet from contaminating the copy sheet handling system.

In accordance with another aspect of the present invention, there is provided an automatic apparatus for controlling and enabling clean and convenient clearance of a stalled copy sheet from a copy sheet handling system of an electrostatographic reproduction machine. The automatic apparatus includes a programmable controller for declaring an error detected in copy sheet movement; position determining means for determining a first actual position of the copy sheet among several such positions at a moment when the controller detects an error. The position determining means includes a first sensing device mounted upstream of an image transfer station of the machine relative to a direction of sheet movement, and a second sensing device, mounted downstream of the first sensing device relative to the direction of sheet movement. The automatic apparatus also includes sheet control and moving means connected to the programmable controller, for changing a position of the copy sheet from the determined first actual position to one of a downstream and an upstream new and convenient sheet removal positions, depending on the determined first actual position of the copy sheet.

BRIEF DESCRIPTION OF THE DRAWINGS

Other aspects of the present invention will become apparent as the following description proceeds and upon reference to the drawings, in which.

DETAILED DESCRIPTION OF THE INVENTION

While the present invention will hereinafter be described in connection with a preferred embodiment, it will be understood that this description is not intended to limit the invention to that embodiment or method of use. On the contrary, the following description is intended to cover all alternatives, modifications, and equivalents, as may be included within the spirit and scope of the invention as defined by the appended claims.

Figure 1:
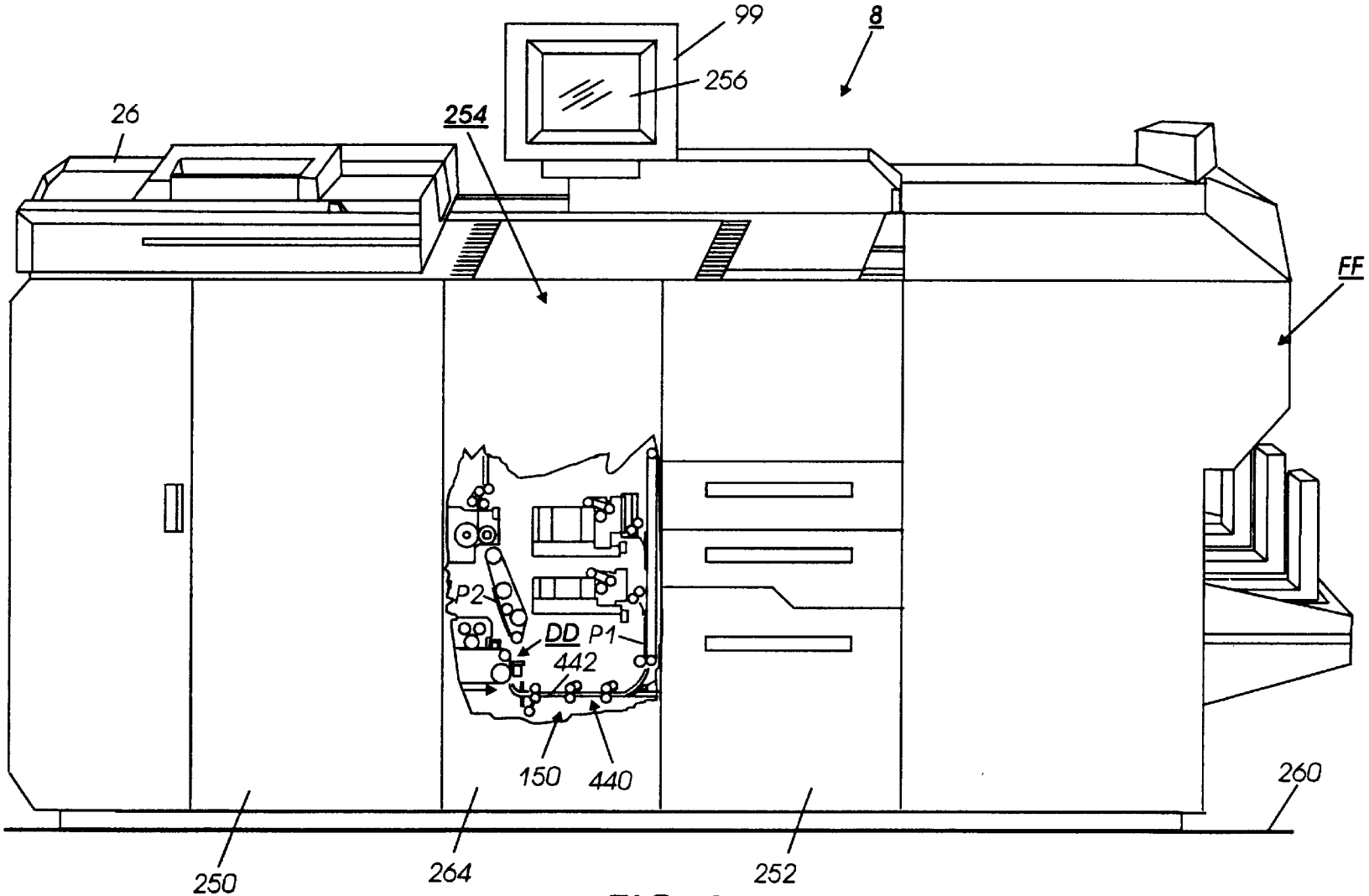
FIG. 1 is a vertical outside view, in perspective of an exemplary electrostatographic machine of the present invention illustrating a pre-fuser portion of a copy sheet transport path, relative to a ground on which the machine stands.
Figure 2:
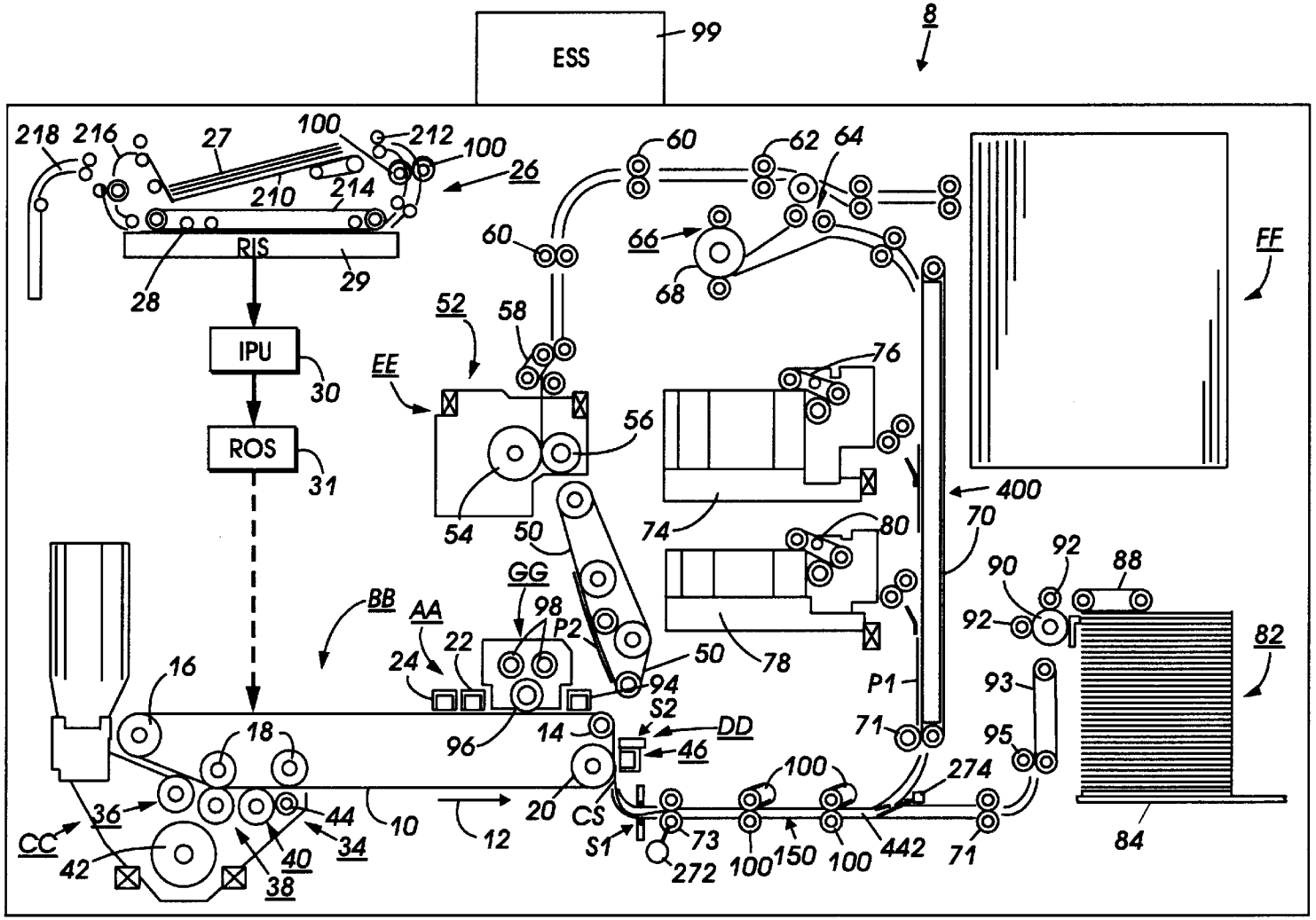
FIG. 2 is a schematic elevational view of the exemplary machine of FIG. 1, incorporating the automatic apparatus, and using the method, of clean convenient copy sheet jam clearance in accordance with the present invention.

Referring initially to FIGS. 1 and 2, a schematic depiction of an exemplary electrostatographic reproducing machine 8 is shown incorporating various machine systems in order to provide a general background and understanding of the features of the present invention. Although the apparatus of the present invention is particularly well adapted for use in an automatic electrostatographic reproduction machine 8 as shown in FIGS. 1 and 2, it will become apparent from the following discussion that the method and apparatus of the present invention for controlling and enabling clean and convenient clearance of a stalled copy sheet from a copy sheet handling system, (to be described in detail below), are equally well suited for use in a wide variety of electrostatographic processing machines, and in many other known printing systems.

Referring now to FIG. 1, the machine 8 includes for example an imaging section 250 above which is mounted a document handier 26. It also includes a copy sheet supply section 252; a finisher section FF; an image transfer and fusing section 254; and a control subsystem (ESS) 99 including an operator control panel 256. As shown, the machine 8 is suitable for setting up on a ground plane 260 which typically is the floor on which a user of the machine stands. Importantly, the image transfer and fusing section 254 includes, for example, a copy sheet jam clearance access door 264 that can be opened to provide access to a portion 440 of the copy sheet handling system 400 of the machine 8.

Referring now to FIG. 2, the exemplary electrostatographic reproduction machine 8 employs a photoconductive belt 10, preferably comprising a photoconductive material coated on a ground layer, which, in turn, is coated on an anti-curl substrate. Belt 10 is entrained about stripping roll 14, tensioning roll 16, rolls 18, and drive roll 20. Stripping roll 14 and rolls 18 are mounted rotatably so as to rotate with belt 10. Tensioning roll 16 is resiliently urged against belt 10 to maintain belt 10 under a desired tension. Drive roll 20 is rotated by a motor (not shown) coupled thereto by any suitable means such as a drive belt. Thus, as roll 20 rotates, it advances belt 10 in the direction of arrow 12 to advance successive portions of the photoconductive surface sequentially through various electrostatographic processing stations disposed about the path of movement thereof.

Initially, a portion of photoconductive belt 10 passes through charging station AA where two corona generating devices, indicated generally by the reference numerals 22 and 24 charge a surface of the photoconductive belt 10 to a relatively high, and substantially uniform potential. This dual or "split" charging system is designed so that corona generating device 22 places all of the required charge on photoconductive belt 10 while corona generating device 24 acts as a leveling device to provide a uniform charge across the surface of the belt. Corona generating device 24 also fills in any areas missed by corona generating device 22.

Next, the charged portion of photoconductive belt 10 is advanced through imaging station BB. At imaging station BB, a document handling unit or handler, indicated generally by reference numeral 26 is positioned over platen 28 of the reproduction machine 8. The document handling unit 26 sequentially feeds documents from a stack 27 of original document sheets placed in a document stacking and holding tray 210 as shown, such that the original document sheets containing images to be copied are loaded, for example, face up in the document tray. As is well known, the document handling unit 26, although shown as a bottom feeder, can also be a top feeder. In either case, a bottom or top sheet respectively is fed seriatim from the stack to rolls 212 for advancing in registration onto platen 28 by means of a belt transport 214. As shown, the belt transport 214 is moved over the platen 28 with the original document sheet being interposed between the platen and the belt transport.

When the original document sheet is properly positioned and registered on platen 28, the document is imaged and the original document is returned to the document tray from platen 28 by either of two paths. If only a simplex copy of the document sheet image is being made or if this is the first pass of a two pass duplex copying process, the original document sheet is returned to the document tray 210 via only a simplex path 216. If the document sheet is to be imaged on a second pass of a two pass duplex copying process, then the original document sheet is instead first moved through a duplex path 218, reimaged, and then returned to the document tray through simplex path 216.

Imaging of the document is achieved by a scanning assembly, preferably comprising a Raster Input Scanner (RIS) 29 for capturing the entire image from the input document and converting the image into a series of raster scan lines corresponding to individual picture elements or so-called pixels making up the original input document. The output signal of the RIS 29 is transmitted as an electrical signal to an Image Processing Unit (IPU) 30 where they are converted into an individual bitmap representing the receptive values of exposure for each pixel. The IPU 30 can store bitmap information for subsequent imaging or can operate in a real time mode. The digital output signal generated by the IPU 30 is transmitted to a Raster Output Scanner (ROS) 31 for writing the image bitmap information onto the charged surface of the photoreceptive belt 10 by selectively erasing charges thereon in a pixel-by-pixel manner.

It should be noted that either a discharged area development (DAD) approach in which discharged portions are developed can be employed, or a charged area development (CAD) approach in which charged areas are developed can be employed, as known in the art. This process records an electrostatic latent image on photoconductive belt 10 corresponding to the informational areas contained within the original document. Thereafter, photoconductive belt 10 advances the electrostatic latent image recorded thereon to development station CC.

At development station CC, a magnetic brush developer housing, indicated generally by the reference numeral 34, is provided, having three developer rolls, indicated generally by the reference numerals 36, 38 and 40. A paddle wheel 42 picks up developer material in the developer housing and delivers the developing material to the developer rolls. When the developer material reaches rolls 36 and 38, it is magnetically split between the rolls with approximately half of the developer material being delivered to each roll. Photoconductive belt 10 is partially wrapped about rolls 36 and 38 to form an extended development zone or nip about each roll.

Developer roll 40 is a cleanup roll and magnetic roll 44 is a carrier granule removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station DD.

At transfer station DD, a copy sheet CS is moved in timed registration, into contact with the toner powder image on belt 10. A high capacity feeder, indicated generally by the reference numeral 82, is the primary source of copy sheets. High capacity feeder 82 includes a tray 84 supported on an elevator (not shown). The elevator is driven by a bi-directional motor to move the tray up or down. In the up position, the copy sheets are advanced from the tray 84 to transfer station DD, via a copy sheet handling system including a vacuum feed belt 88 that feeds successive uppermost sheets from the stack to a take away roll 90, and rolls 92. The take-away roll 90 and rolls 92 guide the sheet to a vertical transport 93. Vertical transport 93 and roll 95 advance the sheet to rolls 71 which, in turn, move the sheet through a registration assembly 150 including force reducing deskew rolls 100 and registration rolls 73, toward the toner image transfer station DD.

As shown, copy sheets may also be fed to transfer station DD from a secondary tray 74 or from an auxiliary tray 78, which each includes an elevator driven by a bi-directional AC motor (not shown) and a control having the ability to drive the tray up or down. When the tray is in the down position, stacks of copy sheets are loaded thereon or unloaded therefrom. In the up position, successive copy sheets may be fed therefrom by a sheet feeder 76 or 80 that includes a friction retard feeder utilizing a feed belt and take-away rolls to advance successive copy sheets to transport 70.

As previously discussed, it is important that proper alignment of the copy sheet is maintained along a transport path 442 of the copy sheet handling system 400 thereof so as to inhibit skew, and so as to provide proper alignment and registration of sheets transported through the transfer station DD. Failure to provide proper copy sheet and timing registration will generally result in unacceptable image transfer to the copy sheet. Typically it is a conventional practice to immediately stop the machine when either a copy sheet or timing registration error is detected. Stopping the machine conventionally as such, of course ordinarily results in the copy sheet being stalled or jammed somewhere along the sheet transport path 442 of the sheet handling system 400.

As shown in FIG. 1 for example, the stalled or jammed copy sheet could be so stalled or jammed in an inconvenient position at and/or between the registration subassembly 150 and the image transfer station DD. As illustrated, the registration subassembly 150 is located so close to the floor on which a machine user stands that it is convenient and even unsafe to attempt to clear or remove the stalled sheet from such location. In addition, a copy sheet already at or partially beyond the transfer station DD has unfused toner on it, and so must be handled with care in order not to contaminate the sheet handling system. Accordingly, attempts to remove a sheet stalled as such without the apparatus and method of the present invention (to be described in detail below), would ordinarily be inconvenient, unsafe, and messy.

Still referring to FIG. 2, at the transfer station DD, when the copy sheet has been delivered in proper timed registration, the developed or toner image on belt 10 contacts the advancing copy sheet CS, and is transferred thereonto. As can be seen in the illustrated embodiment, a corona generating device 46 charges the copy sheet to a proper potential so that the sheet is electrostatically secured or "tacked" to belt 10 and the toner image thereon is attracted to the copy sheet. After image transfer, a second corona generator (not shown) charges the copy sheet to a polarity opposite that provided by corona generator 46 for electrostatically separating or "detacking" the copy sheet from belt 10. Thereafter, the inherent beam strength of the copy sheet causes the sheet to separate from belt 10 onto conveyor 50, positioned to receive the copy sheet for transporting to fusing station EE.

Fusing station EE includes a fuser assembly, indicated generally by the reference numeral 52, which fuses and permanently affixes the transferred toner image to the copy sheet. Preferably, fuser assembly 52 includes a heated fuser roll 54 and a pressure roll 56 with the powder image on the copy sheet contacting fuser roll 54. The pressure roll 56 abuts the fuser roll 54 to provide the necessary pressure to fix the toner powder image to the copy sheet. In this fuser assembly, the fuser roll 54 is internally heated by a quartz lamp while a release agent, stored in a reservoir, is pumped to a metering roll which eventually applies the release agent to the fuser roll.

After fusing, the copy sheets are fed through a decurling apparatus 58 which bends the copy sheet in one direction to put a known curl in the copy sheet, thereafter bending the copy sheet in the opposite direction to remove that curl, as well as any other curls or wrinkles which may have been introduced into the copy sheet. The copy sheet is then advanced, via forwarding roll pairs 60 to duplex turn roll 62. A duplex solenoid gate 64 selectively guides the copy sheet to finishing station FF or to inverter 66. In the finishing station, the copy sheets are collected in sets and the copy sheets of each set can be stapled or glued together. Alternatively, duplex solenoid gate 64 diverts the sheet into inverter 66, providing intermediate storage for one sheet which has been printed on one side and on which an image will be subsequently printed on the second, opposed side thereof, i.e. the sheet being duplexed. In order to complete duplex copying, the simplex sheet in inverter 66 is fed by a feed roll 68 from inverter 66 back to transfer station DD for transfer of the toner powder image to the opposite side of the copy sheet.

Invariably, after the copy sheet has been separated from photoconductive belt 10 subsequent to image transfer therefrom, some residual particles remain attached to the surface of the belt 10. As a result, photoconductive belt 10 passes beneath yet another corona generating device 94 which charges the residual toner particles to the proper polarity for breaking the bond between the toner particles and the belt. Thereafter, a pre-charge erase lamp (not shown), located inside the loop formed by photoconductive belt 10, discharges the photoconductive belt in preparation for the next charging cycle.

Residual particles are removed from the photoconductive surface at cleaning station GG. Cleaning station GG includes an electrically biased cleaner brush 96 and two waste and reclaim de-toning rolls 98. One reclaim roll 98 is electrically biased negatively relative to the cleaner roll 96 so as to remove toner particles therefrom while the other reclaim roll 98 is electrically biased positively relative to the cleaner roll 96 so as to remove paper debris and wrong sign toner particles. The toner particles on the reclaim roll 98 are scraped off and deposited in a reclaim auger (not shown), where they are transported out of the rear of cleaning station GG.

The various machine subsystems described hereinabove (as well as the method and apparatus of the present invention) are typically regulated by the programmable electronic control subsystem (ESS) 99. The ESS 99 is preferably a controller such as a programmable microprocessor capable of managing all of the machine functions. Among other things, the ESS 99 can be programmed to provide a comparison count of the copy sheets, the number of documents being recirculated, the number of copy sheets selected by the operator, time delays, error detection control, jam indications and the state or status of subsystem actuation signals. Conventional sheet path sensors or switches may be utilized to keep track of the position of documents and the sheets in the machine. In addition, the control regulates the various positions of gates and switching depending upon the mode of operation selected.

Figure 3:
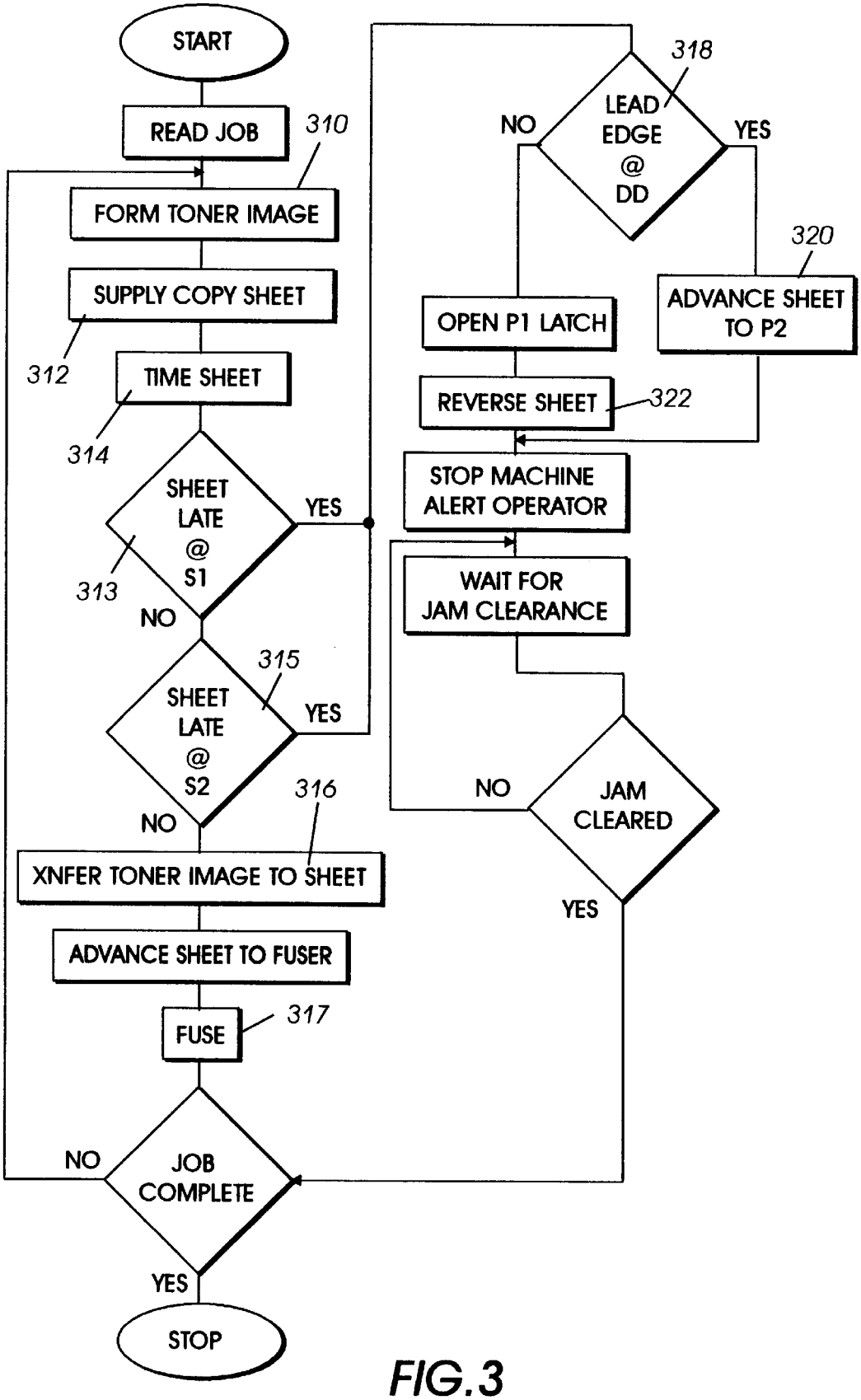
FIG. 3 is a flow chart illustration of the method of clean convenient copy sheet jam clearance in accordance with the present invention.

Referring now to FIGS. 1–3, automatic apparatus including the programmable ESS 99 is provided for controlling and enabling clean and convenient clearance of a stalled copy sheet from said copy sheet handling system. The automatic apparatus importantly includes the programmable controller 99 for declaring detection of an error in copy sheet movement, and position determining means for determining a first actual position of the copy sheet at a moment of error detection. The position determining means includes a first sensing device S1 (registration sensors) mounted upstream of the image transfer station DD relative to sheet movement, and a second sensing device S2, mounted downstream of the first sensing device S1 relative to sheet movement. The automatic apparatus also includes a sheet control and moving means (main drive plus stepper motor 272) connected to the programmable controller for automatically changing, relative to sheet movement, a position of the copy sheet, from the first actual position of the copy sheet, to one of a downstream (P2) and an upstream (P1) new and convenient sheet removal positions, depending on the first actual position of the copy sheet as determined by the first sensing device S1 and the second sensing device S2. Further, the automatic apparatus includes programmed means of the programmable controller for stopping the machine after automatically changing the position of the copy sheet from the first position to one (P1 or P2) of the downstream (P2) and the upstream (P1) new and convenient sheet removal positions.

The first and the second sensing devices, S1, S2 are positioned so as to be capable of sensing a lead edge and a trail edge of a sheet CS being moved by the copy sheet handling system towards and through the image transfer station DD. The sheet control and moving means includes means (main drive plus stepper motor) 272 for reversing an initial forward movement of the copy sheet and moving the copy sheet backwardly past the first sensing device S1 to the new and convenient sheet removal position upstream P1, when the first actual position of the copy sheet is such that a lead edge of the copy sheet is downstream of the first sensing device S1, but upstream of the second sensing device S2. The sheet control and moving means also includes means for continuing the initial forward movement of the copy sheet CS past the second sensing device S2, to the new and convenient sheet removal position downstream P2, when the first actual position of the copy sheet is such that a lead edge of the copy sheet is beyond the first sensing device S1, and at least at the second sensing device S2.

As further shown, the automatic apparatus includes an actuating device such as a solenoid 274 for actuating a switch to open up a latch portion of the copy sheet path 442 upstream of the first sensing device S1, for enabling convenient removal of the reversed copy sheet.

As shown in FIG. 3, the ESS 99 is programmed to read information on any particular job of documents to be reproduced on the machine, and to then control the various subsystems of the machine through a process of completing the job. Completing the job includes, for each document in the job, forming a toner image (box 310) of an image of the document in the manner described above; supplying a copy sheet CS (box 312) to the transfer station DD to receive the toner image; registering and timing the movement (box 314) of the copy sheet; transferring the toner image (box 316) from the belt 10 to the copy sheet; and advancing the copy sheet to the fuser where the toner image thereon is fused and affixed (box 317) to the copy sheet. Completing the job also includes controlling the machine through copy sheet jams, for example, and enabling clean and convenient clearance of a stalled copy sheet from the copy sheet handling system 400. As discussed above, copy sheet jams or stalling of copy sheets occur due to detected machine or copy sheet handling errors.

In accordance with the present invention, when a machine or copy sheet handling error is detected, for example, indicating that a copy sheet is late to registration sensors shown as S1, (a late-to-registration error box 313 FIG. 3), or late to a prefuser sensor S2, (a late-to-prefuser error box 315 FIG. 3), the controller 99 declares a detected error, determines (box 318 FIG. 3) the actual position (first actual position) of the sheet at the time of detection of such error. As shown, although the copy sheet can have any of several positions along the sheet transport path, the important inquiry according to the present invention is whether or not the lead edge of the copy sheet has reached the transfer station DD, as determined from the prefuser sensor S2.

Depending on this first actual position of the lead edge of the copy sheet (box 318) (which can be, and is ordinarily inconvenient and hard to reach), the machine will be controlled to either drive the sheet (box 320 FIG. 3) further forward from such actual position, or drive it in reverse (box 322 FIG. 3) from such first actual position, to a relatively more convenient to reach position P1, P2 as shown.

Further and in accordance with the present invention, in the case of a late-to-registration error, if the first actual position of the sheet is such that the lead edge of the sheet had already moved passed the registration sensors S1, and had also reached the tack or transfer point of the image transfer station DD, as sensed by S2, then the drive system including a registration stepper motor 272 will drive the sheet forward from such first actual position of the sheet to a downstream convenient and safe position for sheet removal shown as P2 at the prefuser transport 50. Such forward driving of the copy sheet should be continued until the trail edge of the copy sheet is moved passed the prefuser sensor S2, or until a timeout occurs. It is important to drive the sheet forwardly in this case (rather than in reverse as below), so as to avoid contaminating the registration subsystem drive rolls (73, and 100) with toner from any portion of the toner image already transferred to an area of the sheet along the lead edge that reached the transfer station DD.

However, if at the time of detection of a late-to-registration error, the first actual position of the sheet is such that the lead edge of the sheet had already passed the registration sensors S1, but had not reached the tack point of the image transfer station DD, as sensed by S2, then the drive system including the registration stepper motor 272, will stop, reverse their forward direction, and instead drive the sheet in reverse (box 322 FIG. 3) from its first actual position, back to an upstream convenient and safe position for sheet removal, shown as P1, at the vertical sheet transport subassembly 70. The reverse driving of the sheet as such should be continued until the lead edge of the sheet is backed out of the nip of the registration subsystem drive rolls (73, 100, 71).

As pointed out above, in order to accommodate and enable removal of the copy sheet being reversed as such in the transport path 442, an actuating mechanism such as a solenoid 274 operates in order to open a latch to the vertical sheet transport subassembly 70, ahead (in time) of the sheet being reversed.

In the case of a late-to-prefuser error (box 315), if the sheet has a first actual position such that its lead edge has passed the registration sensors S1, but had not reached the tack point of the image transfer station, the sheet will be reversed in the same manner as above. If however the actual position is such that the lead edge had reached the tack point, the forward movement of the sheet will be continued, and the sheet will be moved to the convenient and safe jam clearance position P2, as above.

In either case, the continued forward feeding, or reversing of the sheet, is performed automatically following detection of an error, before the machine is shut down and an operator is alerted or notified of a jam, or of stalled sheets to be removed from P1 or P2. At machine shutdown following prior automatic movement or changing of the position of the stalled sheet in accordance with the present invention, the user or operator opens the jam clearance door 264 (FIG. 1), and is then directed to convenient locations P1 or P2, depending on where the sheet or sheets involved in the jam have been moved to for removal or clearance.

Alternatively to use of S2 at the tack or transfer point of the image transfer station, a timing registration system of the machine 8 can be used to time movement of the sheet continuously from the registration sensors S1, thus enabling determination of a position of the lead edge automatically (if there is no sheet drive slippage) without reliance on a second sensor S2.

The use of the forward and reversing motions in the registration subsystem of the present invention advantageously enables a jammed sheet of copy paper to be forwarded past the tack point of the image transfer station DD, or to be reversed and delivered, to a relatively more convenient and safe position P2, P1 respectively that is higher above the floor plane 260 (FIG. 1) for operator access and removal.

To recapitulate, the present invention discloses a method of cleanly and conveniently controlling and enabling clearing of a stalled copy sheet in a copy sheet handling system of an electrostatographic reproduction machine. The method includes the steps of declaring detection of an error in copy sheet movement through the copy sheet handling system; determining a first actual position of a copy sheet among several possible such positions within the handling system at a moment of error detection; identifying a location of a lead edge of the copy sheet in relation to a first sensing device located upstream of an image transfer station of the machine and in relation to a second sensing device located downstream of the image transfer station, relative to sheet movement.

The method also includes automatically changing a position of the copy sheet from the determined first actual position to one of two new and convenient sheet removal positions depending on the first actual position of the copy sheet at a moment of error detection; stopping the machine after changing the position of the copy sheet from the first actual position to one of the two new and convenient sheet removal positions, and alerting an operator of a copy sheet to be removed from the handling system; thereby enabling safe and convenient removal of the copy sheet, and preventing the copy sheet from contaminating the sheet copy sheet handling system.

For effecting the method of the present invention there is provided an automatic apparatus for controlling and enabling clean and convenient clearance of a stalled copy sheet from a copy sheet handling system of an electrostatographic reproduction machine. The automatic apparatus includes a programmable controller for declaring detection of an error in copy sheet movement; position determining means for determining a first actual position of the copy sheet among several such positions at a moment when the controller detects an error.

The position determining means includes a first sensing device mounted upstream of an image transfer station of the machine relative to a direction of sheet movement, and a second sensing device, mounted downstream of the first sensing device relative to the direction of sheet movement. The automatic apparatus also includes sheet control and moving means connected to the programmable controller, for changing a position of the copy sheet from the determined first actual position to one of a downstream and an upstream new and convenient sheet removal positions depending on the determined first actual position of the copy sheet.

It is, therefore, evident that there has been provided, in accordance with the present invention, a method and apparatus that fully satisfy the aims and advantages hereinbefore set forth. While this invention has been described in conjunction with a preferred embodiment and method of use, it is evident that many alternatives, modifications, and variations will be apparent to those skilled in the art. Accordingly, it is intended to embrace all such alternatives, modifications and variations as fall within the spirit and broad scope of the appended claims.

We claim:

1. In an electrostatographic reproduction process machine having means for forming a toner image, a copy sheet handling system, an image transfer station for transferring the toner image to a transported and registered copy sheet, a fuser for fusing and affixing the toner image to the copy sheet, and a programmable control system, a method of cleanly and conveniently controlling and enabling clearing of a jammed copy sheet from the sheet handling system, the method comprising:

(a) detecting an error in copy sheet movement;

(b) determining a first actual position within the handling system of a sheet having a lead edge thereto closest to the image transfer station of the machine;

(c) identifying a location of such lead edge in relation to a first sensing device upstream, relative to sheet movement, of the image transfer station and in relation to a second sensing device downstream, relative to sheet movement, of the image transfer station;

(d) actuating a solenoid switch to open up a latching portion of a copy sheet path portion, upstream of the first sensing device, relative to the initial forward movement of the copy sheet;

(e) automatically changing a position of the sheet from the first actual position to a new and convenient sheet removal position, depending on the location of such lead edge as identified in said identifying step; and (f) stopping the machine following said automatically change step, and alerting an operator of a copy sheet to be removed from the sheet handling system.

2. The method of claim 1, wherein said detecting step comprises detecting a late-to-registration timing error due to the copy sheet arriving late to sheet registration subassembly sensors of the sheet handling system.

3. The method of claim 1, wherein said detecting step comprises detecting a late-to-prefuser timing error due to the copy sheet arriving late to a prefuser sensor.

4. The method of claim 1, wherein said identifying step comprises identifying a location of such lead edge of the sheet as being downstream, relative to sheet movement, of the first sensing device and upstream of the second sensing device.

5. The method of claim 4, wherein said changing step comprises reversing an initial forward movement of the copy sheet and moving the copy sheet backwardly past the first sensing device to a new and convenient sheet removal position upstream of the first sensing device, relative to the initial forward movement of the copy sheet.

6. The method of claim 1, wherein said identifying step comprises identifying a location of such lead edge of the sheet as being beyond the first sensing device and at least at the second sensing device.

7. The method of claim 6, wherein said changing step comprises continuing an initial forward movement of the copy sheet and moving the copy sheet passed the second sensing device to a new and convenient sheet removal position downstream of the second sensing device, relative to the initial forward movement of the copy sheet.

* * * * *